US005187490A

United States Patent [19]

Ohta et al.

[11] Patent Number: 5,187,490

[45] Date of Patent: Feb. 16, 1993

[54] STRIPLINE PATCH ANTENNA WITH SLOT PLATE

[75] Inventors: Masahiko Ohta, Shimodate; Kazuo Kaneko, Yokohama; Hiroyuki Iyama, Tokyo; Seizi Kado, Shimodate; Mitisuru Hirao, Shimodate; Hironori Ishizaka, Shimodate; Kenji Ohmaru; Takao Murata, both of Tokyo, all of Japan

[73] Assignee: Hitachi Chemical Company, Ltd., Japan

[21] Appl. No.: 823,598

[22] Filed: Jan. 17, 1992

Related U.S. Application Data

[63] Continuation of Ser. No. 572,126, Aug. 23, 1990, abandoned.

[30] Foreign Application Priority Data

Aug. 25, 1989 [JP] Japan ..... 1-219488

[51] Int. Cl.[5] ..... H01Q 13/100; H01Q 13/080

[52] U.S. Cl. ..... 343/770; 343/700 MS

[58] Field of Search ..... 343/700 MS, 767-770, 343/771, 846

[56] References Cited

U.S. PATENT DOCUMENTS

| | | | |
|---|---|---|---|
| 3,832,716 | 8/1974 | Plunk et al. | 343/770 |
| 4,426,649 | 1/1984 | Dubost et al. | 343/700 MS |
| 4,554,549 | 11/1985 | Fassett | 343/700 MS |
| 4,623,893 | 11/1986 | Sabban | 343/700 MS |
| 4,761,654 | 8/1988 | Zaghloul | 343/700 MS |
| 4,816,835 | 3/1989 | Abiko et al. | 343/700 MS |
| 4,922,263 | 5/1990 | Dubost et al. | 343/700 MS |
| 4,977,406 | 12/1990 | Tsukamoto et al. | 343/700 MS |

FOREIGN PATENT DOCUMENTS

| | | | |
|---|---|---|---|
| 0243289 | 10/1987 | European Pat. Off. . | |
| 0295003 | 12/1988 | European Pat. Off. . | |
| 0128903 | 10/1980 | Japan | 343/770 |
| 0264804 | 11/1986 | Japan . | |
| 0046305 | 2/1989 | Japan . | |
| 2092827 | 8/1982 | United Kingdom . | |

OTHER PUBLICATIONS

K. C. Kelly, Recent Annular Slot Array Experiments, I.R.E. Nat. Conv. Record, Part I, Mar. 18-21, 1957, pp. 144-152.

NEC Corp., Osamu Amano, "Slot Antenna for Circularly Polarized Wave", vol. 12, No. 397, Oct. 21, 1988, Japanese Patent Abstract.

Koichi Ito, "Planar Antennas for Satellite Reception", IEEE Transactions on Broadcasting, vol. 34, No. 4, Dec. 1988.

*Primary Examiner*—Rolf Hille
*Assistant Examiner*—Peter Toby Brown
*Attorney, Agent, or Firm*—Jones & Askew

[57] ABSTRACT

A stripline patch antenna having a slot plate which is capable of obtaining higher antenna gain, while reducing the loss due to the feed lines. The antenna includes at least one radiating element for transmitting and receiving radio waves; a feed line for transmitting signals to and from the radiating element; a dielectric substrate for supporting the radiating element means and the feed line means; a grounding conductor located below the dielectric substrate; and a slot plate located above the dielectric substrate, having a plurality of slots more numerous than the radiating element. The triplate substrate can be adapted to this antenna. A plurality of antenna units so constructed can be arranged in array such that at least one of the slots of each antenna unit is shared with a neighboring antenna unit.

32 Claims, 17 Drawing Sheets

STRIPLINE PATCH ANTENNA WITH SLOT PLATE

This is a continuation of application Ser. No. 07/572,126, filed Aug. 23, 1990, now abandoned.

BACKGROUND OF THE INVENTION

1. Field of the Invention

The present invention relates to a so called stripline patch type antenna to be utilized in a microwave communication.

2. Description of the Background Art

Presently, parabola antennas and plane antennas are utilized for the microwave communication. Since the satellite broadcasting has started, although the parabola antennas are more commonly employed for this purpose so far, plane antennas have been attracting much attentions, because plane antennas are thin plate shaped, light weighted, and hence easier to handle.

Up to date, various types of plane antennas have been developed, including a microstrip antenna, a strip patch antenna, a radial line antenna, and a suspended line antenna.

In particular, a type of a plane antenna in which the strip patch antenna is combined with a slot plate is known to be capable of obtaining a high antenna gain.

An example of a stripline patch antenna with a slot plate is shown in FIGS. 1(A) and 1(B). This stripline patch antenna 101 comprises a plate shaped dielectric substrate 102, a grounding conductor plate 103 attached on a back of the dielectric substrate 102, a square shaped radiating element 104 attached on a front of the dielectric substrate 102, a feed line 105 connected to the radiating element 104, and a slot plate 107 having a slot 106 above the radiating element 104, which is mounted at a prescribed distance above the dielectric substrate 102. Although not shown in FIGS. 1(A) and 1(B), the entire antenna is formed from a plurality of radiating element 104 and slot 106 combinations just described.

In this stripline patch antenna 101, when signals to be transmitted are supplied from a transmitter device through the feed line 105, the signals are transformed into radio wave by the radiating element 104, which is then emitted through the slot 106. On the other hand, when the radio wave is received through the slot 106, this radio wave is transformed into signals by the radiating element 104, and the obtained signals are then supplied to a receiver device through the feed line 105.

A relationship between relative antenna gain and an angle for this stripline patch type antenna 101 at 12 GHz frequency is shown in FIG. 2, while a relationship between relative dielectric constant of the dielectric substrate 102 and antenna gain for this stripline patch antenna 101 is shown in FIG. 3. As can be seen from FIG. 3, the antenna gain for this stripline patch antenna is at most 10 dB, but material having a relative dielectric constant of about 2 is normally used, so that the antenna gain is usually about 7 to 8 dB.

This implies that in order to obtain the antenna gain of over 30 dB, which is required for a satellite broadcasting receiver, it is necessary to have 500 to 1000 radiating elements 104 in a single plane antenna.

However, if number of the radiating elements 104 is increased, with ample separation between neighboring radiating elements maintained, then the feed lines 105 have to be lengthened, which in turn increases loss due to the feed lines 105. This is because, in order to obtain the maximum effective signal transmission through the feed lines 105, the impedance of the feed lines 105 has to be adjusted by changing the widths of the feed lines 105, while the feed lines 105 also have to make turns and branches in order to be arranged in the space between the radiating elements 104, and such changing widths and turning and branching of the feed lines 105 are the source of the loss due to the feed lines 105, which will be increased when the feed lines 105 are lengthened.

In a case of the stripline patch antenna 101 which is equipped with the slot plate 107, the feed lines 105 are effectively shielded between the grounding conductor plate 103 and the slot plate 107, so that the loss due to the feed lines 105 is less than that for an antenna without a slot plate. However, in this case, the transmission losses within the feed lines 105 themselves are larger, so that when gain of over 30 dB is to be obtained, efficiency of only about 50 to 60% can be achieved. This is inferior to parabola antenna which can achieve the efficiency of over 70% for the same gain. Consequently, in order to achieve the same high efficiency as the parabola antenna does by the plate antenna, the area of the plane antenna has to be 20 to 40% larger than that of the parabola antenna.

On the other hand, if the separation between the neighboring radiating elements is shortened, the loss due to interference between the neighboring radiating elements 104 or between the radiating elements 104 and the feed lines 105 increases, so that it is difficult to obtain efficiency of over 90% by revising the arrangement, even if the loss due to feed lines 105 themselves is ignored.

SUMMARY OF THE INVENTION

It is therefore an object of the present invention to provide a stripline patch antenna having a slot plate which is capable of obtaining higher antenna gain, while reducing loss due to the feed lines.

According to one aspect of the present invention there is provided a stripline patch type antenna, comprising: radiating element means for transmitting and receiving radio waves; feed line means for transmitting signals to and from the radiating element means; a dielectric substrate for supporting the radiating element means and the feed line means; a grounding conductor located below the dielectric substrate; and a slot plate located above the dielectric substrate, having a plurality of slots more numerous than the radiating element means.

According to another aspect of the present invention there is provided a stripline patch type antenna, comprising: a triplate substrate, including: a lower slot plate having a lower slot; feed conductor means, extending to a position below the lower slot, for transmitting signals; a dielectric substrate for supporting the feed lines means; and a grounding conductor located below the dielectric substrate; and an upper slot plate located above the triplate substrate, having a plurality of upper slots more numerous than the lower slot.

According to another aspect of the present invention there is provided a stripline patch type plane antenna, comprising: a plurality of antenna units arranged in array, each antenna unit including: radiating element means for transmitting and receiving radio waves; feed line means for transmitting signals to and from the radiating element means; dielectric substrate for supporting the radiating element means and the feed line means; grounding conductor located below the dielectric substrate; and slot plate located above the dielectric substrate, having a plurality of slots more numerous than the radiating element means.

Other features and advantages of the present invention will become apparent from the following description taken in conjunction with the accompanying drawings.

DETAILED DESCRIPTION OF THE PREFERRED EMBODIMENTS

Figure 4:
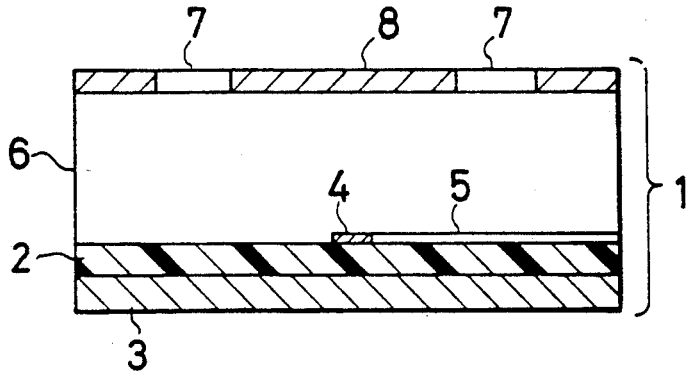
FIGS. 4(A) and 4(B) are cross sectional view and top plan view, respectively, of a first embodiment of a stripline patch type antenna with a slot plate according to the present invention.
Figure 4:
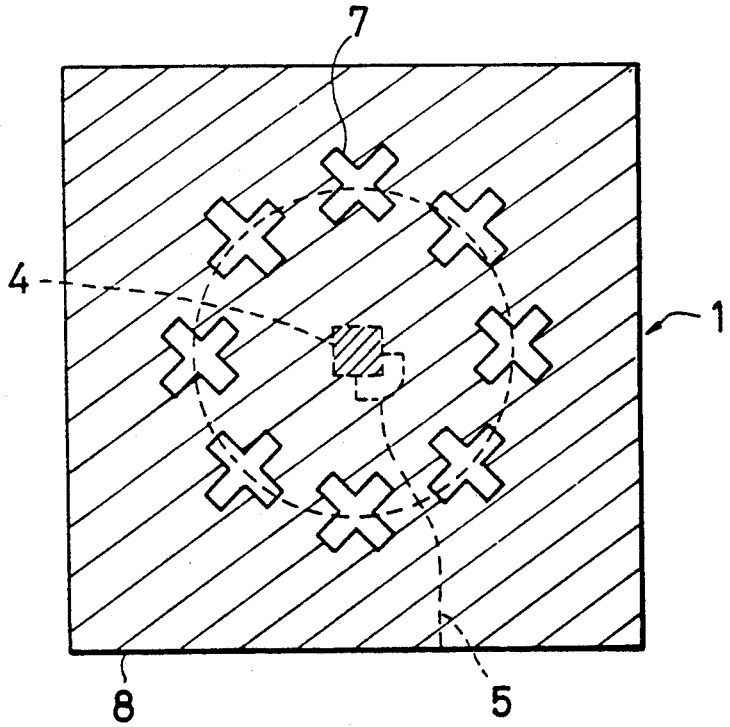

Referring now to FIGS. 4(A) and 4(B), a first embodiment of a stripline patch type antenna with a slot plate, according to the present invention, will be described.

This stripline patch type antenna 1 comprises a flat plate shaped dielectric substrate 2, a grounding conductor plate 3 attached underneath the dielectric substrate 2, a square shaped radiating element 4 attached over the dielectric substrate 2, a feed line 5 connected to two sides of the radiating element 4, an air layer 6 formed above the dielectric substrate 2, and a metal plate 8 having a plurality (more than a number of associated radiating element 4) of slots 7 on a circle centered around a position directly above the radiating element 4. This arrangement of the slots 7 on a circle is not indispensable but preferable. In general, it is preferable to arrange the slots 7 symmetrically with respect to the associated radiating element 4. In practice, a plurality of such an antenna unit will be arranged in array to form a single plane antenna.

In this stripline patch type antenna 1, when signals to be transmitted are supplied from a transmitter device through the feed line 5, the signals are transformed into radio wave by the radiating element 4, which is then emitted through the slots 7. On the other hand, when the radio wave is received through the slots 7, this radio wave is transformed into signals by the radiating element 4, and the obtained signals are then supplied to a receiver device through the feed line 5.

The dielectric substrate 2 is made from an insulative material of small dielectric loss and relative dielectric constant, such as foamed polyethylene. For this dielectric substrate 2, use of an organic insulative material is preferable, but a foamed material containing air inside, or air itself may also be used. In case air is used for the dielectric substrate 2, supporting members for supporting the radiating element 4 and the grounding conductor plate 3 have to be provided.

The grounding conductor plate 3 is made of a metallic material or a metallic film formed from a metallic material such as aluminum, iron, copper, nickel, or an alloy containing these metals. Actually, any metallic material can be used for this grounding conductor plate 3, although those enumerated above are preferable choices in terms of economical consideration and mechanical and electrical properties. This grounding conductor plate can be manufactured as a thin layer formed by a sputtering or a vaporization applied to the dielectric substrate 2, or as a thin metal foil formed by metal rolling, or an electrolytic metal plating, which is attached to the dielectric substrate 2. The thickness of this grounding conductor plate is such that a transmission efficiency of over 90% is attainable for a conducting body given by a surface skin effect which depends on a frequency and an amount of current, and more preferably such that the transmission efficiency of over 99% is attainable for the conducting body given by the surface skin effect. Also, this grounding conductor plate 3 may be placed at a prescribed distance apart from the dielectric substrate 2 if desired.

The radiating element 4 and the feed line 5 can be formed by a general wiring method such as an etching of a selected portion of a metal foil attached in advance to the dielectric substrate 2, or an electroless plating applied to an appropriate conductor element, or a silk printing of an appropriate conductor element in paste like state.

The metal plate 8 is made from a metallic material such as aluminum, iron, copper, nickel, or an alloy containing these metals. The slots 7 on this metal plate 8 can be formed by a press die cutting, an etching, or a laser manufacturing. As for a shape of each slot 7, a cross shape is most common, but other shapes such as circular square, and others may also be used.

As an example, a stripline patch type antenna was constructed by using an aluminum plate of 0.5 mm thickness as the metal plate 8, foamed polyethylene sheet of 0.8 mm thickness and 1.77 relative dielectric constant as the dielectric substrate 2, metal rolled copper foils of 35 μm thickness manufactured by etching as the radiating element 4 and feed line 5, and an aluminum plate of 1 mm thickness as the grounding conductor plate 3. In this example of a stripline patch type antenna, the air layer 6 of 8 mm thickness is formed between the dielectric substrate 2 and the metal plate 8, and eight slots 7 are arranged at regular intervals on a circle of 14 mm radius centered around the radiating element 4, where each slot is formed by combining a slot of 3 mm width and 12.5 mm length in cross shape.

Figure 1A:
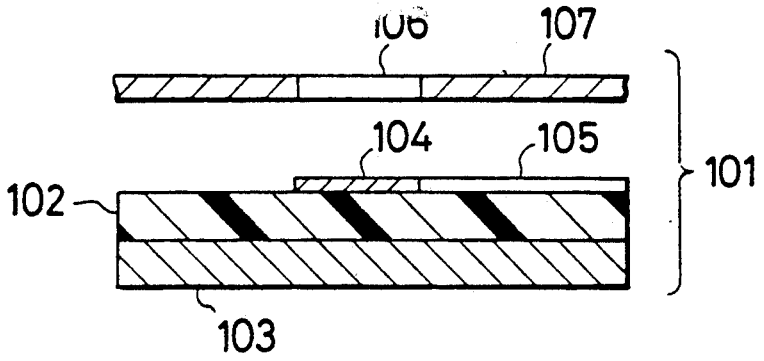
FIG. 1(A) PRIOR ART
FIG. 1(A) is a cross sectional view of an example of a conventional stripline patch antenna having a slot plate.
Figure 1B:
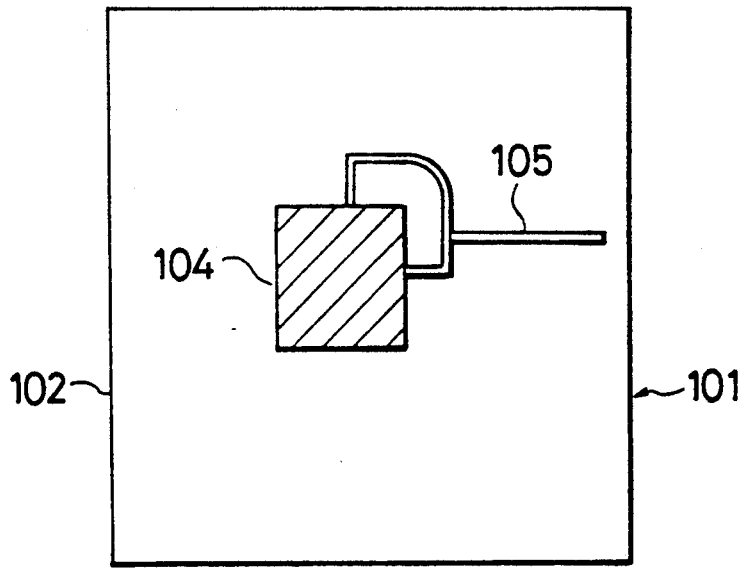
FIG. 1(B) PRIOR ART
FIG. 1(B) is a top view of the example of a conventional stripline patch antenna of FIG. 1.
Figure 2:
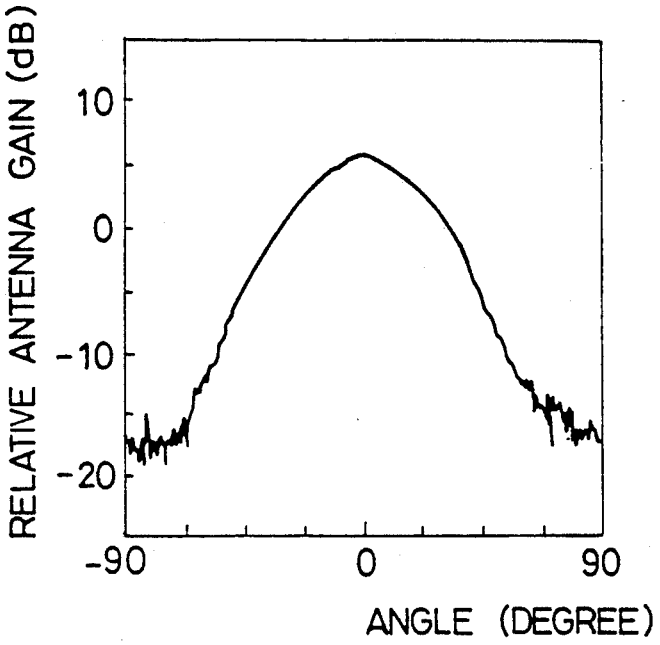
FIG. 2 (PRIOR ART)
FIG. 2 is a graph of a relative antenna gain versus a angle for the example of a conventional stripline patch antenna of FIG. 1.
Figure 3:
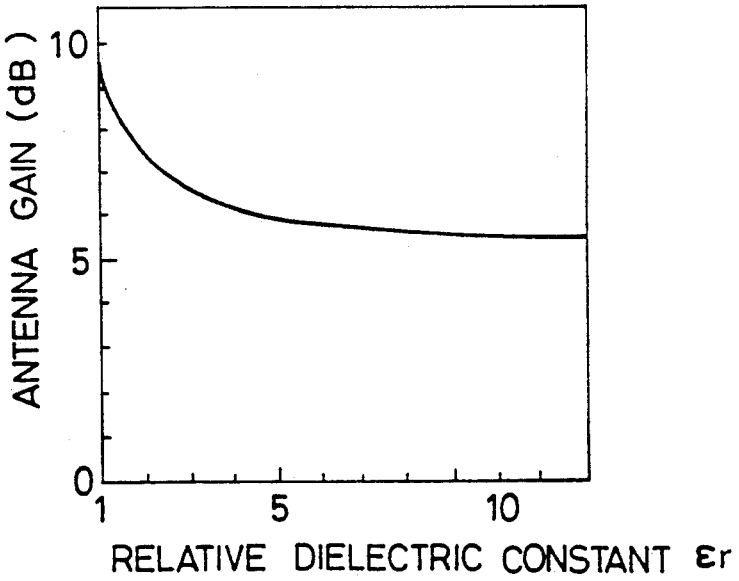
FIG. 3 PRIOR ART
FIG. 3 is a graph of an antenna gain versus a relative dielectric constant for the example of a conventional stripline patch antenna of FIG. 1.
Figure 5:
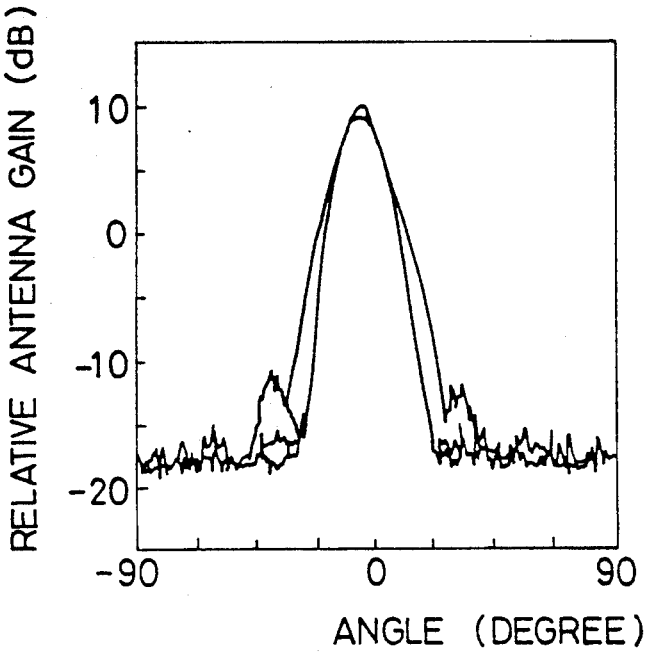
FIG. 5 is a graph of a relative antenna gain versus an angle for an example of a stripline patch antenna constructed in accordance with the first embodiment of FIGS. 4(A) and 4(B).
Figure 6:
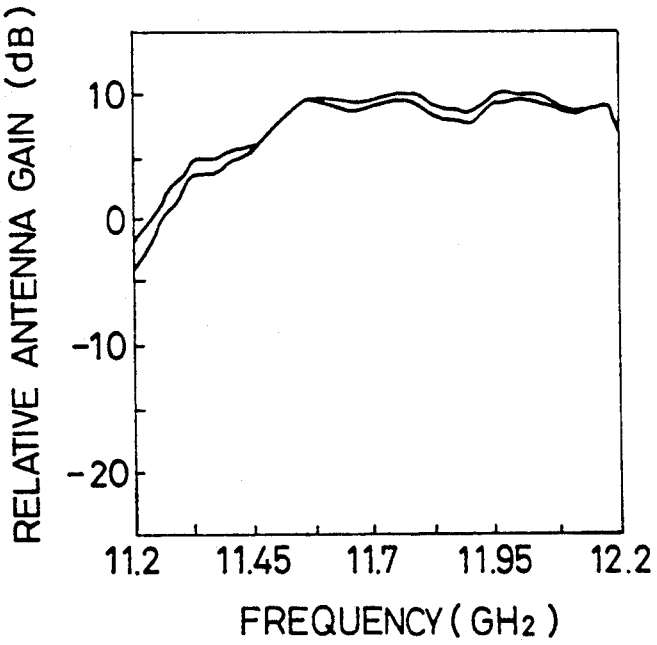
FIG. 6 is a graph of a relative antenna gain versus a frequency for an example of a stripline patch antenna constructed in accordance with the first embodiment of FIGS. 4(A) and 4(B).

With this example of a stripline patch type antenna, the relationships between relative antenna gain and an angle at 11.7 GHz and 12 GHz frequencies, and relative antenna gain and frequency were measured, the results of which are shown in FIG. 5 and FIG. 6, respectively. By comparing the graph of FIG. 5 with a corresponding graph for a conventional stripline patch type antenna shown in FIG. 2, it can be seen that the antenna gain can be improved by about 4 dB by this example of a stripline patch type antenna. This improvement is due to the improved directivity achieved by narrowing a beam width of the radio wave transmitted or received through the slots 7, which is resulting from the configuration of this first embodiment in which a number of the slots 7 provided is greater than that of the radiating element 4, so that the radio wave to be transmitted or received by the radiating element 4 is broken up into narrow beams having the same gain.

Since it is possible to improve the antenna gain by using this first embodiment of a stripline patch type antenna, it becomes possible to reduce a number of radiating elements 4 to be incorporated in a single antenna for satellite broadcasting reception, which in turn enables reducing the length of the feed line 5 as well as the number of branchings and turnings on the feed line 5.

Now, there are various other embodiments of the present invention which can be viewed as variations of the first embodiment described above. Such embodiments will now be described with references to the drawings, where those elements identical to corresponding elements appeared in the first embodiment are given the same reference numerals in the drawings and their descriptions will be omitted.

Figure 7:
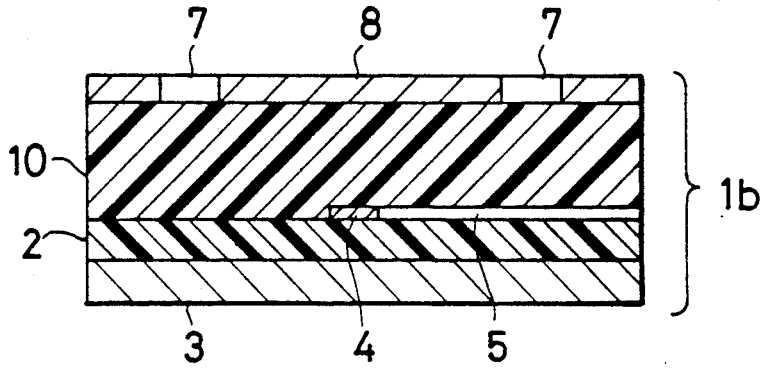
FIG. 7 is a cross sectional view of a second embodiment of a stripline patch type antenna with a slot plate according to the present invention.

Referring now to FIG. 7, a second embodiment of a stripline patch type antenna with a slot plate according to the present invention will be described.

In this second embodiment, the antenna 1*b* differs from the antenna 1 of the first embodiment in that the air layer 6 shown in FIG. 4(A) is replaced by a foamed material layer 10 of 8 mm thickness and relative dielectric constant of approximately one. Since this foamed material layer 10 can functions similarly to the air layer 6 of the first embodiment, the results similar to those obtained for the first embodiment, such as those shown in FIGS. 5 and 6, can also be obtained by this second embodiment.

Figure 8:
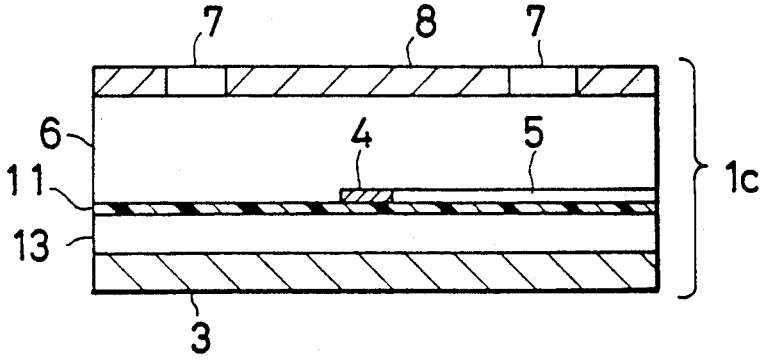
FIG. 8 is a cross sectional view of a third embodiment of a stripline patch type antenna with a slot plate according to the present invention.

Referring now to FIG. 8, a third embodiment of a stripline patch type antenna with a slot plate according to the present invention will be described.

In this third embodiment, the antenna 1*c* differs from the antenna 1 of the first embodiment in that the dielectric substrate 2 shown in FIG. 4(A) is replaced by a combination of a dielectric film 11 such as a polyethylene film of 25 μm thickness and another air layer 13 formed between this dielectric film 11 and the grounding conductor plate 3. Since this combination of the dielectric film 11 and the air layer 13 can functions similarly to the dielectric substrate 2 of the first embodiment, the results similar to those obtained for the first embodiment, such as those shown in FIGS. 5 and 6, can also be obtained by this third embodiment.

Figure 9:
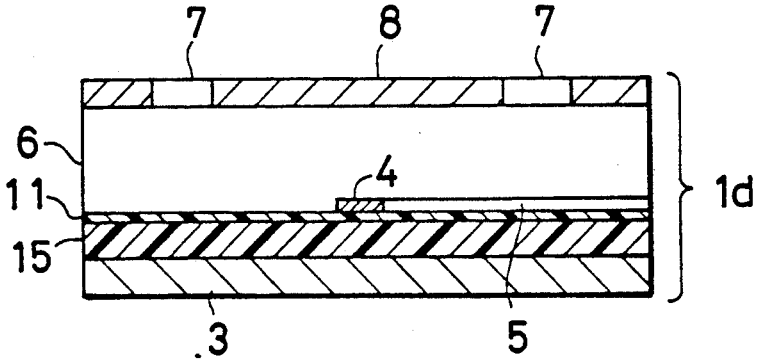
FIG. 9 is a cross sectional view of a fourth embodiment of a stripline patch type antenna with a slot plate according to the present invention.

Referring now to FIG. 9, a fourth embodiment of a stripline patch type antenna with a slot plate according to the present invention will be described.

In this fourth embodiment, the antenna 1*d* differs from the antenna 1 of the first embodiment in that the dielectric substrate 2 shown in FIG. 4(A) is replaced by a combination of a dielectric film 11 such as a polyethylene film of 25 μm thickness and a foamed material layer 15 of low relative dielectric constant formed between this dielectric film 11 and the grounding conductor plate 3. Since this combination of the dielectric film 11 and the foamed material layer 15 can functions similarly to the dielectric substrate 2 of the first embodiment, the results similar to those obtained for the first embodiment, such as those shown in FIGS. 5 and 6, can also be obtained by this fourth embodiment.

Figure 10:
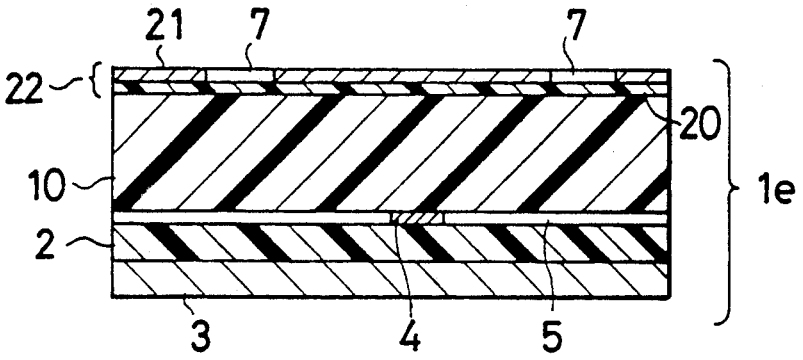
FIG. 10 is a cross sectional view of a fifth embodiment of a stripline patch type antenna with a slot plate according to the present invention.

Referring now to FIG. 10, a fifth embodiment of a stripline patch type antenna with a slot plate according to the present invention will be described.

In this fifth embodiment, the antenna 1*e* differs from the antenna 1 of the first embodiment in that the metal plate 8 shown in FIG. 4(A) is replaced by a layered film 22 formed from a dielectric film 20 made of a polyethylene sheet of 25 μm thickness and relative dielectric constant of 2.44, and a metal rolled copper foil 21 of 35 μm thickness, where the slots 7 are formed by etching the copper foil 21 at appropriate locations, while the air layer 6 shown in FIG. 4(A) is replaced by a foamed material layer 10 of 8 mm thickness and relative dielectric constant of approximately 1, as in the second embodiment above, where the layered film 22 has the dielectric film 20 facing the foamed material layer 10. Since the layered film 22 and the foamed material layer 10 can function similarly to the metal plate 8 and the air layer 6 of the first embodiment, results similar to those obtained for the first embodiment, such as those shown in FIGS. 5 and 6, can also be obtained by this fifth embodiment.

Figure 11:
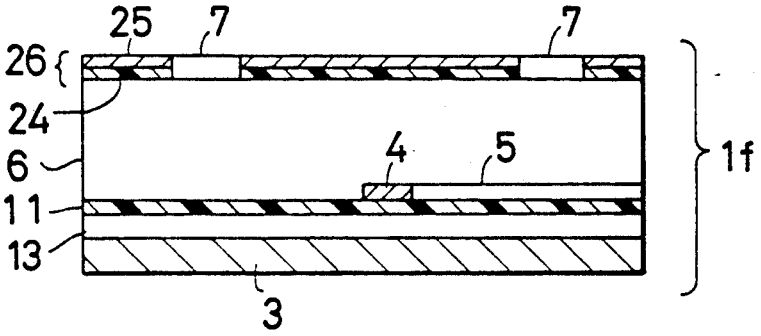
FIG. 11 is a cross sectional view of a sixth embodiment of a stripline patch type antenna with a slot plate according to the present invention.

Referring now to FIG. 11, a sixth embodiment of a stripline patch type antenna with a slot plate according to the present invention will be described.

In this sixth embodiment, the antenna 1*f* differs from the antenna 1 of the first embodiment in that the metal plate 8 shown in FIG. 4(A) is replaced by a layered film 26 formed from a dielectric film 24 made of a polyethylene sheet, of 25 μm thickness and relative dielectric constant of 2.44, and a metal rolled copper foil 25 of 35 μm thickness, where the slots 7 are formed by die cutting this layered film 26 at appropriate locations, while the dielectric substrate 2 shown in FIG. 4(A) is replaced by a combination of a dielectric film 11 and another air layer 13 formed between this dielectric film 11 and the grounding conductor plate 3, as in the third embodiment above. Since these layered film 26 and the combination of the dielectric film 11 and the air layer 13 can function similarly to the metal plate 8 and the dielectric substrate 2 of the first embodiment, results similar to those obtained for the first embodiment, such as those shown in FIGS. 5 and 6, can also be obtained by this sixth embodiment.

Figure 12:
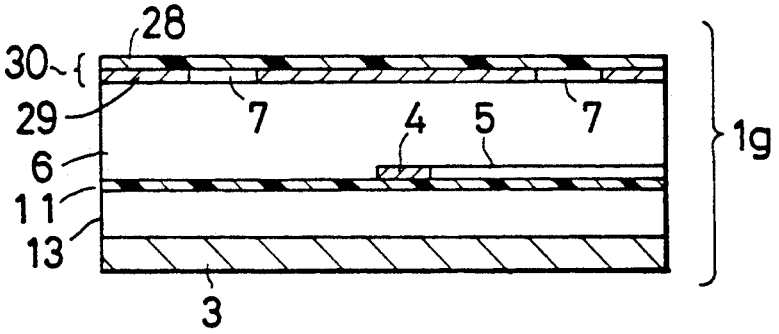
FIG. 12 is a cross sectional view of a seventh embodiment of a stripline patch type antenna with a slot plate according to the present invention.

Referring now to FIG. 12, a seventh embodiment of a stripline patch type antenna with a slot plate according to the present invention will be described.

In this seventh embodiment, the antenna 1*g* differs from the antenna 1 of the first embodiment in that the metal plate 8 shown in FIG. 4(A) is replaced by a layered film 31 formed from a dielectric film 30 made of a polyethylene sheet 28 of 25 μm thickness and relative dielectric constant of 2.44, and a metal rolled copper foil 29 of 35 μm thickness, where the slots 7 are formed by etching the copper foil 29 at appropriate locations, and where the layered film 30 has the copper foil 29 facing the air layer 6, while the dielectric substrate 2 shown in FIG. 4(A) is replaced by a combination of a dielectric film 11 and another air layer 13 formed between this dielectric film 11 and the grounding conductor plate 3, as in the third embodiment above. Since these layered film 30 and the combination of the dielectric film 11 and the the air layer 13 can function similarly to the metal plate 8 and the dielectric substrate 2 of the first embodiment, results similar to those obtained for the first embodiment, such as those shown in FIGS. 5 and 6, can also be obtained by this seventh embodiment.

Figure 13:
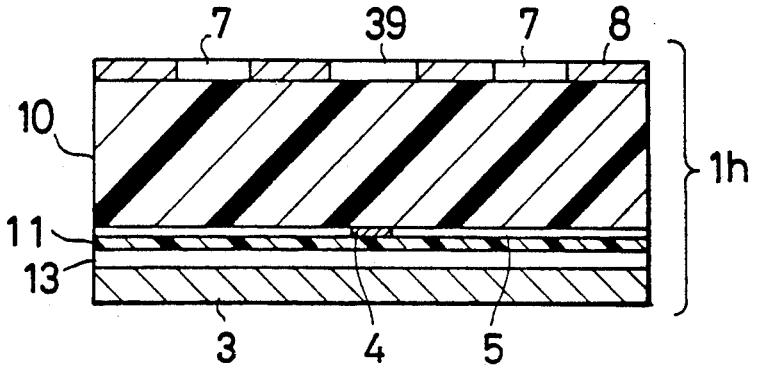
FIGS. 13(A) and 13(B) are cross sectional view and top plan view, respectively, of an eighth embodiment of a stripline patch type antenna with a slot plate according to the present invention.
Figure 13:
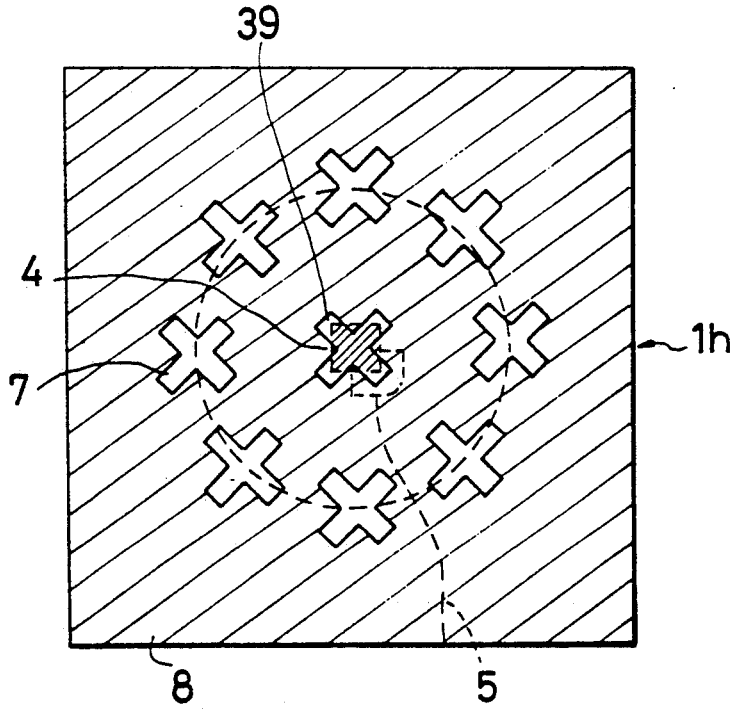

Referring now to FIGS. 13(A) and 13(B), an eighth embodiment of a stripline patch type antenna with a slot plate according to the present invention will be described.

In this eighth embodiment, the antenna 1*h* differs from the antenna 1 of the first embodiment in that the air layer 6 shown in FIG. 4(A) is replaced by a foamed material layer 10 of 8 mm thickness and relative dielectric constant of approximately 1, as in the second embodiment above, while the dielectric substrate 2 shown in FIG. 4(A) is replaced by a combination of a dielectric film 11 and another air layer 13 formed between this dielectric film 11 and the grounding conductor plate 3, as in the third embodiment above, and furthermore an additional slot 39 is provided on the metal plate 8 at a position directly above the radiating element 4. Even with this additional slot 39, because of the function of the other slots 7, results similar to those obtained for the first embodiment, such as those shown in FIGS. 5 and 6, can also be obtained by this eighth embodiment.

Figure 14:
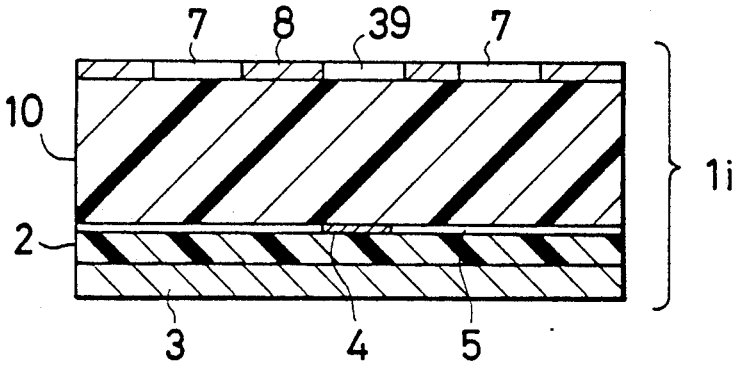
FIGS. 14(A) and 14(B) are cross sectional view and top plan view, respectively, of a ninth embodiment of a stripline patch type antenna with a slot plate according to the present invention.
Figure 14:
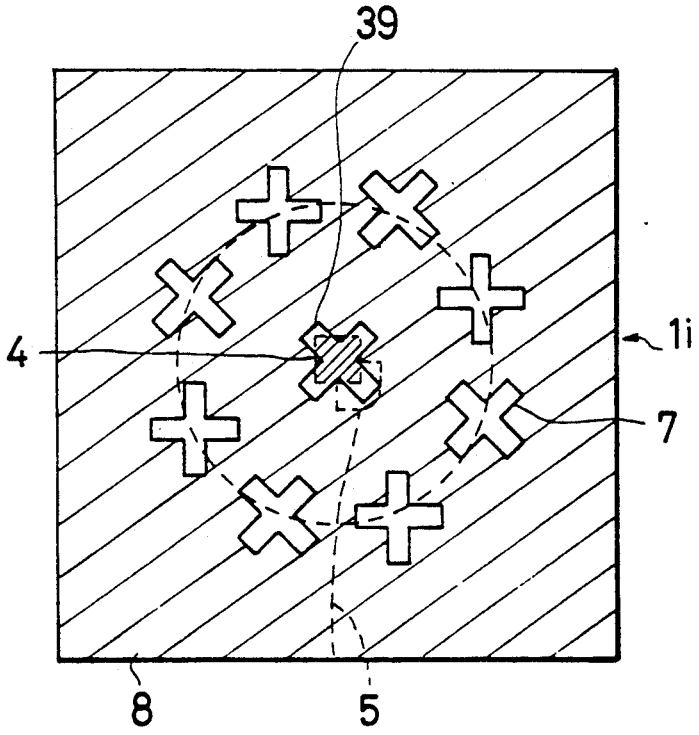

Referring now to FIGS. 14(A) and 14(B), a ninth embodiment of a stripline patch type antenna with a slot plate according to the present invention will be described.

In this ninth embodiment, the antenna 1*i* differs from the antenna 1 of the first embodiment in that the air layer 6 shown in FIG. 4(A) is replaced by a foamed material layer 10 of 8 mm thickness and relative dielectric constant of approximately 1, as in the second embodiment above, while an additional slot 39 is provided on the metal plate 8 at a position directly above the radiating element 4, as in the eighth embodiment above, and furthermore the slots 7 are formed such that each one of the slots 7 is oriented in a direction which differs by 45° from those of the neighboring ones. Even with this configuration of the slots 7, because the slots 7 function essentially in the same manner, results similar to those obtained for the first embodiment, such as those shown in FIGS. 5 and 6, can also be obtained by this ninth embodiment.

Figure 15:
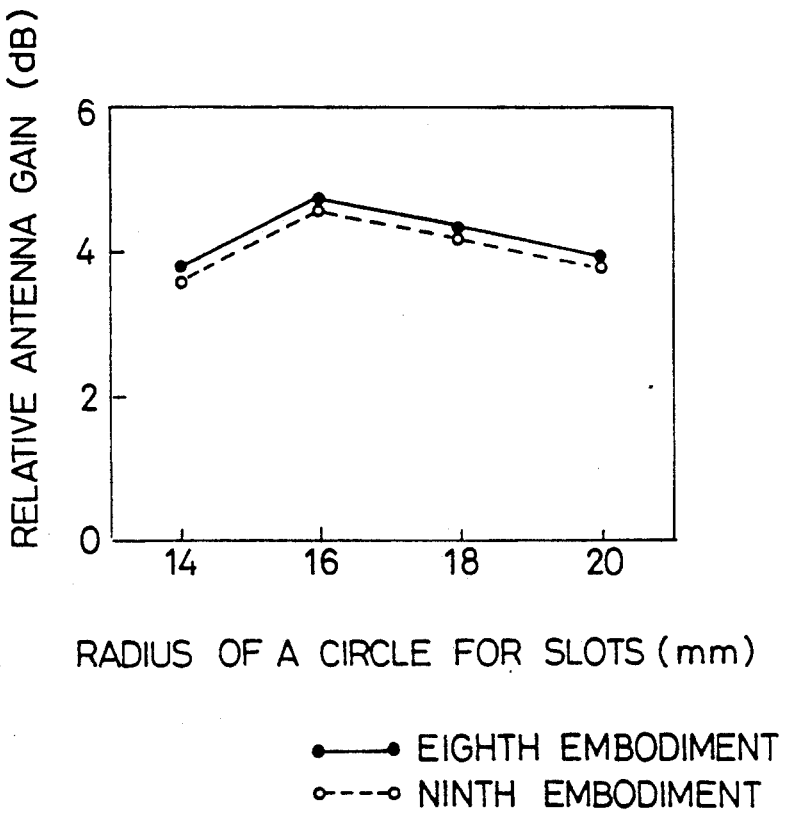
FIG. 15 is a graph of a relative antenna gain versus a radius of a circle along which the slots are arranged in the eighth and ninth embodiments of a stripline patch antenna of FIGS. 13(A) and 13(B), and FIGS. 14(A) and 14(B).

Now, as variations of these eighth and ninth embodiments just described, samples have been constructed in which a radius of the circle on which the slots 7 are arranged is changed from 14 mm of the eighth and ninth embodiments to 16 mm, 18 mm, and 20 mm, while the other elements are retained exactly the same as in the eighth and ninth embodiments. The results obtained by these samples for the relative antenna gain are shown in FIG. 15, which shows that results similar to those obtained for the first embodiment can also be obtained by these variations.

Figure 16:
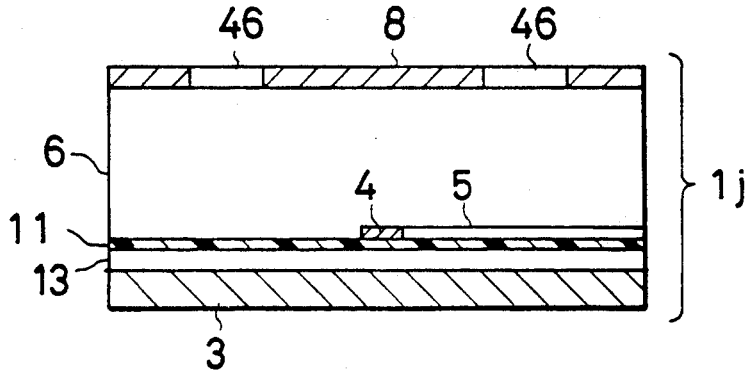
FIGS. 16(A) and 16(B) are cross sectional view and top plan view, respectively, of a tenth embodiment of a stripline patch type antenna with a slot plate according to the present invention.
Figure 16:
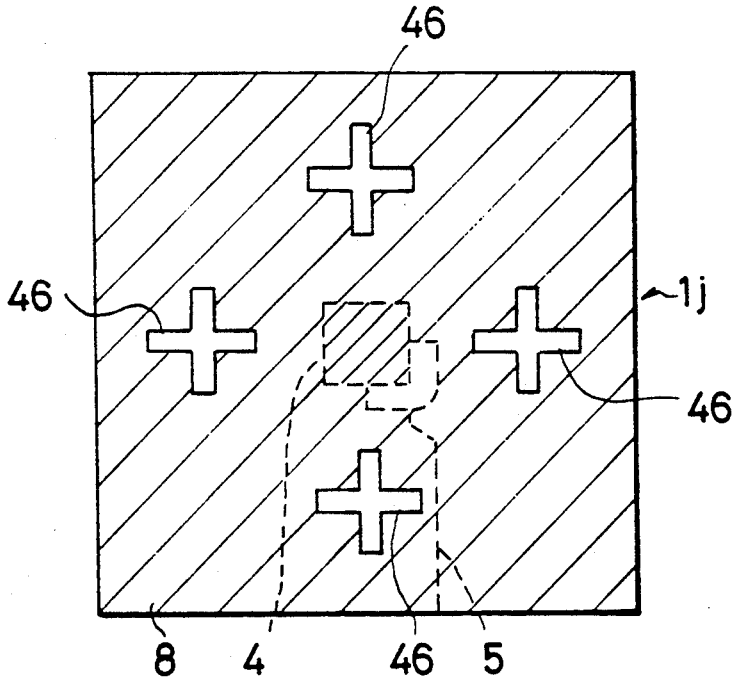

Referring now to FIGS. 16(A) and 16(B), a tenth embodiment of a stripline patch type antenna with a slot plate according to the present invention will be described.

In this tenth embodiment, the antenna 1*j* differs from the antenna 1 of the first embodiment in that the eight slots 7 shown in FIG. 4(A) are replaced by four slots 46 arranged on the same circle of 14 mm radius centered around the position directly above the radiating element 4, while the dielectric substrate 2 shown in FIG. 4(A) is replaced by a combination of a dielectric film 11 and another air layer 13 formed between this dielectric film 11 and the grounding conductor plate 3, as in the third embodiment above. Even with these slots 46 of reduced number, because these slots 46 can still function essentially in the same manner as the slots 7 of the first embodiment, results similar to those obtained for the first embodiment, such as those shown in FIGS. 5 and 6, can also be obtained by this tenth embodiment.

Figure 17:
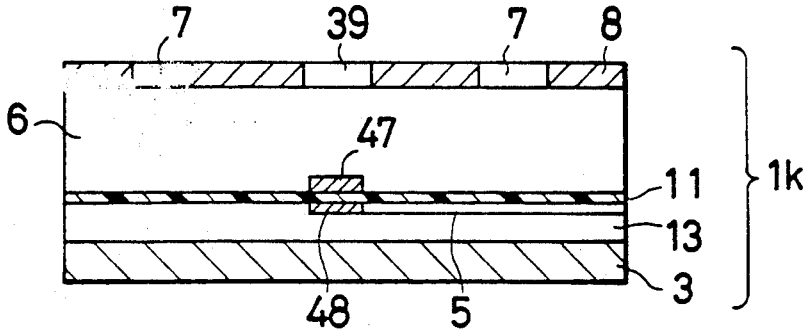
FIG. 17 is a cross sectional view of an eleventh embodiment of a stripline patch type antenna with a slot plate according to the present invention.

Referring now to FIG. 17, an eleventh embodiment of a stripline patch type antenna with a slot plate according to the present invention will be described.

In this eleventh embodiment, the antenna 1*k* differs from the antenna 1 of the first embodiment in that an additional slot 39 is provided on the metal plate 8 at a position directly above the radiating element 4, as in the eighth embodiment above, while the dielectric substrate 2 shown in FIG. 4(A) is replaced by a combination of a dielectric film 11 and another air layer 13 formed between this dielectric film 11 and the grounding conductor plate 3, as in the third embodiment above, and furthermore the radiating element 4 shown in FIG. 4(A) is replaced by a passive element 47 located below the additional slot 39 on the dielectric film 11 and a lower radiating element 48 located below the passive element 47 on another side of the dielectric film 11 to which the feed line 5 is connected. Even with this combination of the passive element 47 and the lower radiating element 48, because of the slots 7, results similar to those obtained for the first embodiment, such as those shown in FIGS. 5 and 6, can also be obtained by this eleventh embodiment.

Figure 18:
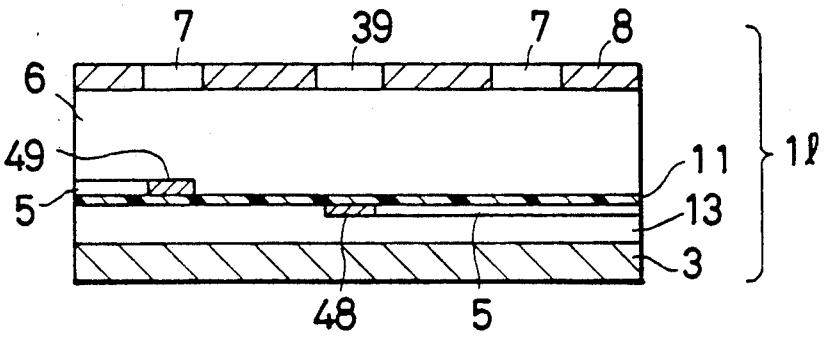
FIG. 18 is a cross sectional view of a twelfth embodiment of a stripline patch type antenna with a slot plate according to the present invention.

Referring now to FIG. 18, a twelfth embodiment of a stripline patch type antenna with a slot plate according to the present invention will be described.

In this twelfth embodiment, the antenna 1*l* differs from the antenna 1 of the first embodiment in that an additional slot 39 is provided on the metal plate 8 at a position directly above the radiating element 4, as in the eighth embodiment above, while the dielectric substrate 2 shown in FIG. 4(A) is replaced by a combination of a dielectric film 11 and another air layer 13 formed between this dielectric film 11 and the grounding conductor plate 3, as in the third embodiment above, and furthermore the radiating element 4 shown in FIG. 4(A) is replaced by an upper radiating element 49 located below one of the slots 7 on the dielectric film 11 and a lower radiating element 48 located below the additional slot 39 on another side of the dielectric film 11, where the upper radiating element 49 and the lower radiating element 48 are supplied with signals with 90° phase difference from the feed lines 5 connected to them. Even with this combination of the upper radiating element 49 and the lower radiating element 48, because of the slots 7, results similar to those obtained for the first embodiment, such as those shown in FIGS. 5 and 6, can also be obtained by this twelfth embodiment.

Figure 19:
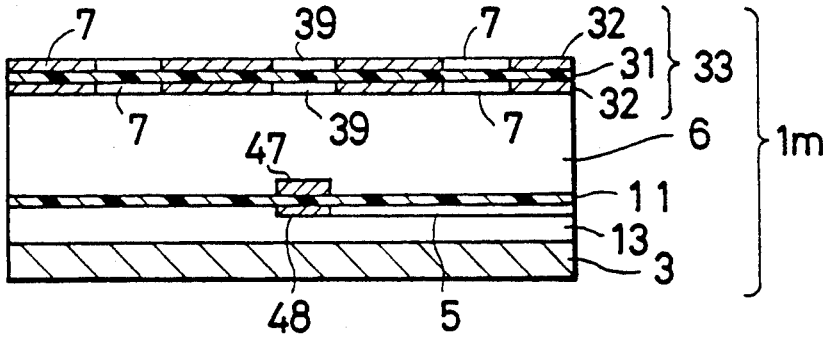
FIG. 19 is a cross sectional view of a thirteenth embodiment of a stripline patch type antenna with a slot plate according to the present invention.

Referring now to FIG. 19, a thirteenth embodiment of a stripline patch type antenna with a slot plate according to the present invention will be described.

In this thirteenth embodiment, the antenna 1 *m* differs from the antenna 1 of the first embodiment in that an additional slot 39 is provided on the metal plate 8 at a position directly above the radiating element 4, as in the eighth embodiment above, while the dielectric substrate 2 shown in FIG. 4(A) is replaced by a combination of a dielectric film 11 and another air layer 13 formed between this dielectric film 11 and the grounding conductor plate 3, as in the third embodiment above, and furthermore the radiating element 4 shown in FIG. 4(A) is replaced by a passive element 47 located below the additional slot 39 on the dielectric film 11 and a lower radiating element 48 located below the passive element 47 on another side of the dielectric film 11 to which the feed line 5 is connected, as in the eleventh embodiment above, and moreover the metal plate 8 shown in FIG. 4(A) is replaced by a layered film 33 formed from a dielectric film 31 made of a polyethylene sheet of 25 μm thickness and relative dielectric constant of 2.44, which is sandwiched between two metal rolled copper foils 32 of 35 μm thickness each, where the slots 7 and 39 are formed by etching these copper foils 32 at appropriate locations. Even with such a layered film 33, because of the slots 7, results similar to those obtained for the first embodiment, such as those shown in FIGS. 5 and 6, can also be obtained by this thirteenth embodiment.

Now, as already mentioned above, in practice, a plurality of antenna units such as those described as various embodiments will be arranged in array to form a single plane antenna. In forming this array, it is preferable to arrange the slots 7 such that some of the slots 7 can be shared by neighboring antenna units, so as to reduce the area of the entire plane antenna.

Figure 20:
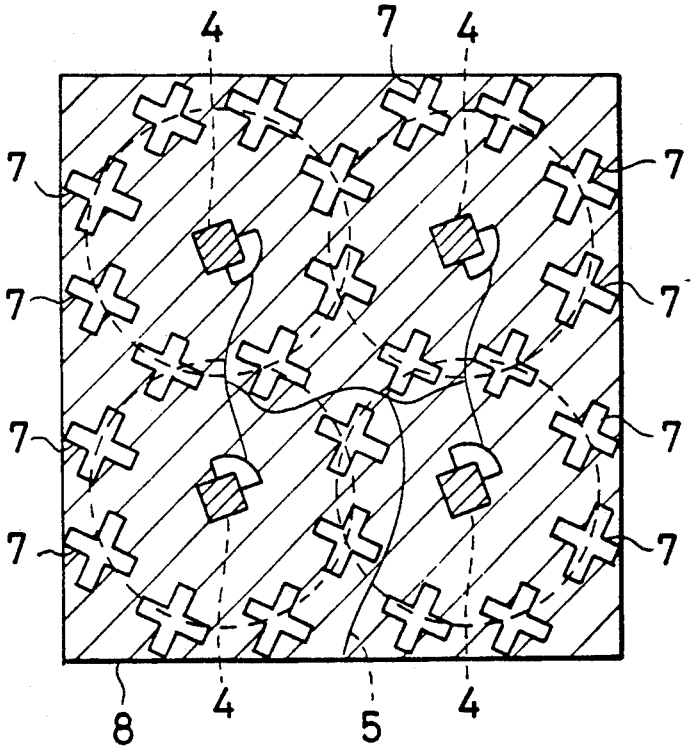
FIG. 20 is a top view of one example of arrangement of the slots in array to construct a plane antenna from antenna units.

For example, as shown in FIG. 20, a plurality of antenna units, each in a form of the first embodiment described above, may be arranged such that each antenna unit shares two of the slots 7 with each one of the neighboring antenna units, where these two slots to be shared are located on the intersections made on the circles for the slots 7 of the neighboring antenna units.

Figure 21:
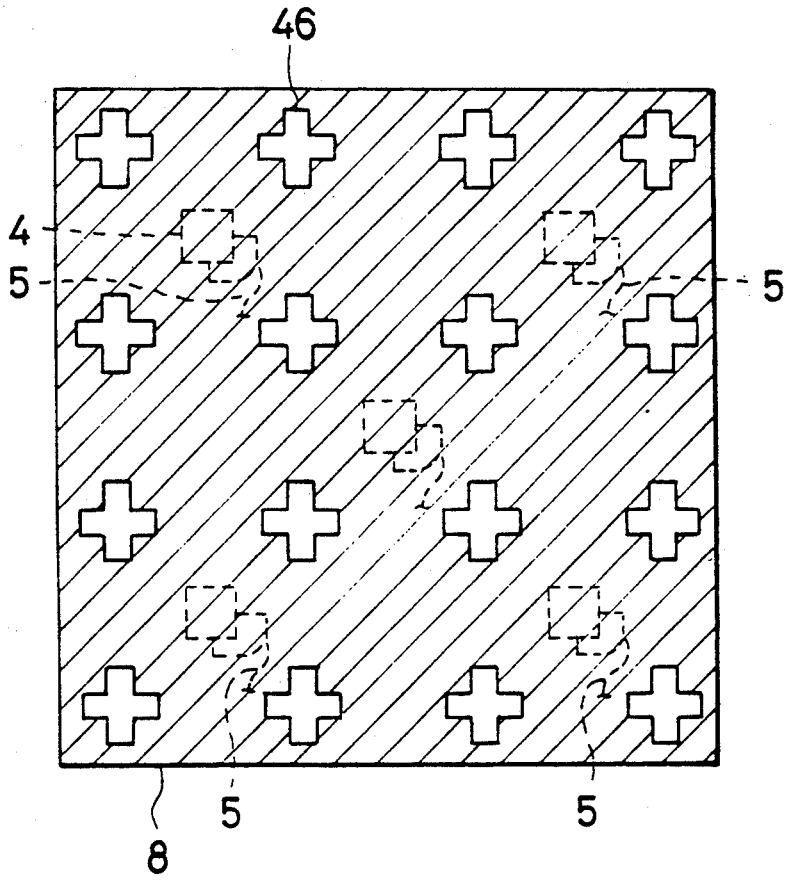
FIG. 21 is a top view of another example of arrangement of the slots in array to construct a plane antenna from antenna units.

Another example is shown in FIG. 21, where the plurality of antenna units, each having four slots 46 in a manner similar to the tenth embodiment described above, may be arranged such that each antenna unit shares one of the slots 46 with each one of the antenna units located at upper left, upper right, lower left, and lower right sides.

Figure 22:
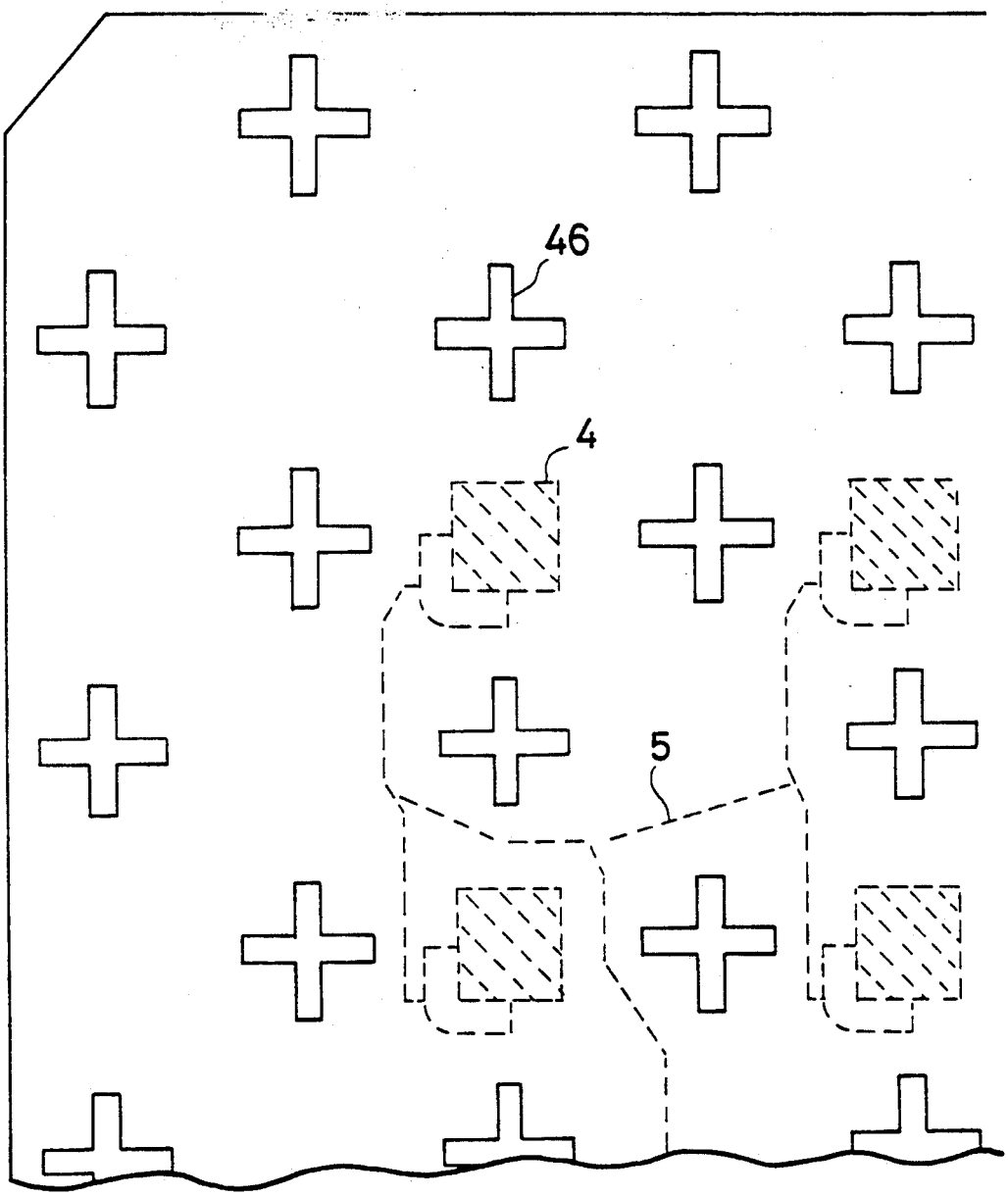
FIG. 22 is a top view of another example of arrangement of the slots in array to construct a plane antenna from antenna units.

Another example is shown in FIG. 22, where the plurality of antenna units, each in a form of the tenth embodiment described above, may be arranged such that each antenna unit shares one of the slots 46 with each one of the antenna units located at left, right, upper, and lower sides.

Figure 23:
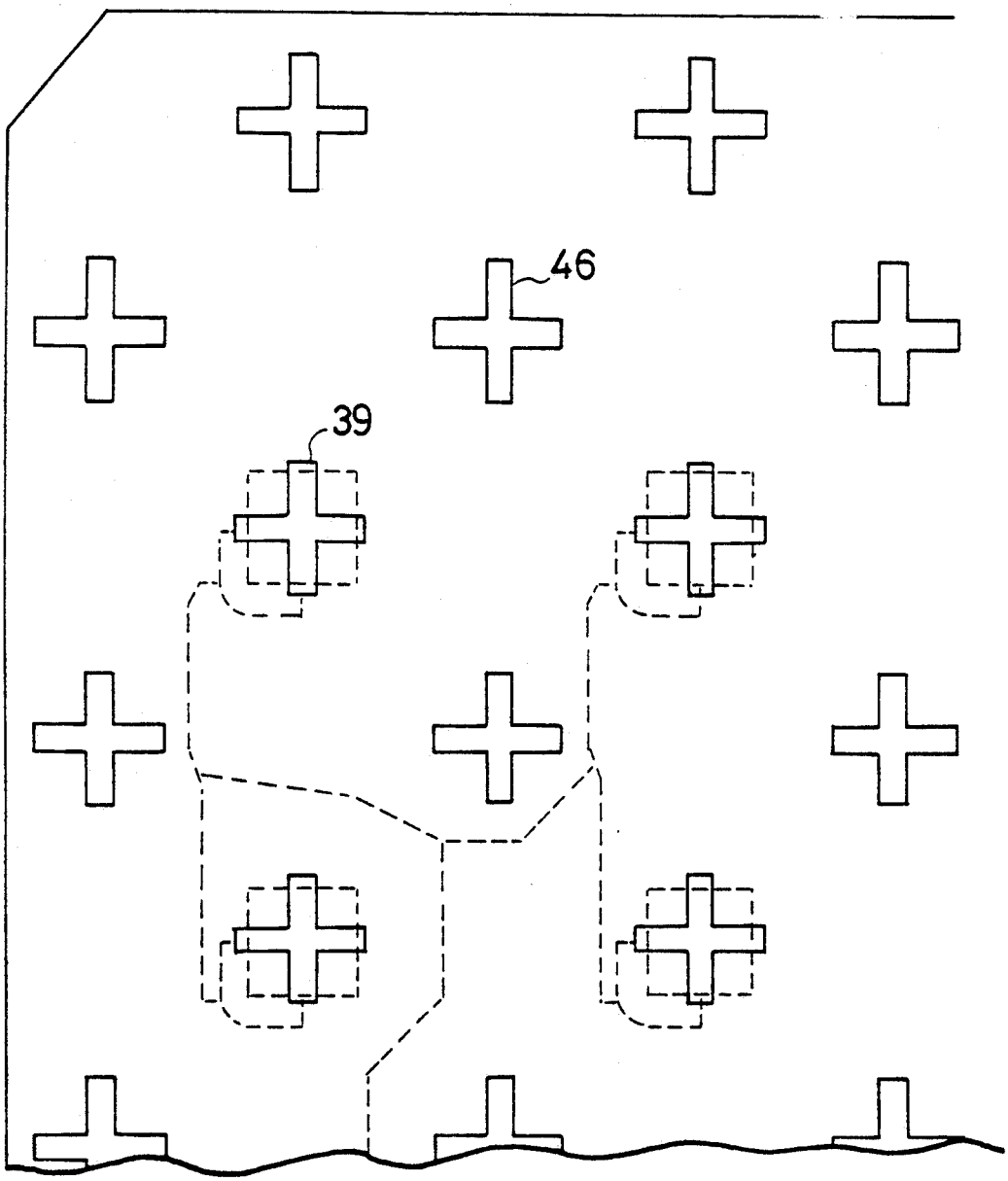
FIG. 23 is a top view of another example of arrangement of the slots in array to construct a plane antenna from antenna units.

Another example is shown in FIG. 23, where the plurality of antenna units, each having four slots 46 in a manner similar to the tenth embodiment described above plus one slot 39 located above the radiating element 4, may be arranged such that each antenna unit shares two of the slots 46 with each one of the antenna units located at left, right, upper, and lower sides.

Figure 24A:
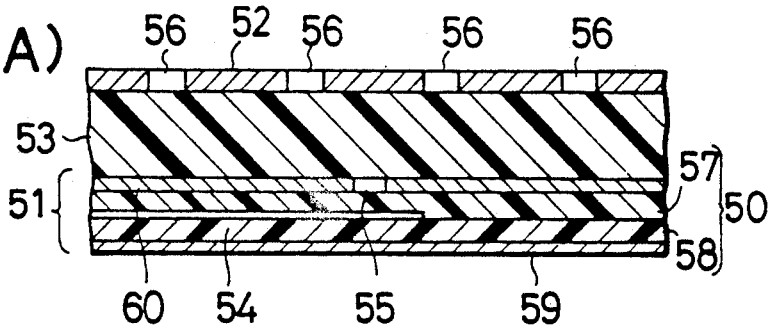
FIGS. 24(A) and 24(B) are cross sectional view and top plan view, respectively, of a fourteenth embodiment of a stripline patch type antenna with a slot plate according to the present invention.
Figure 24B:
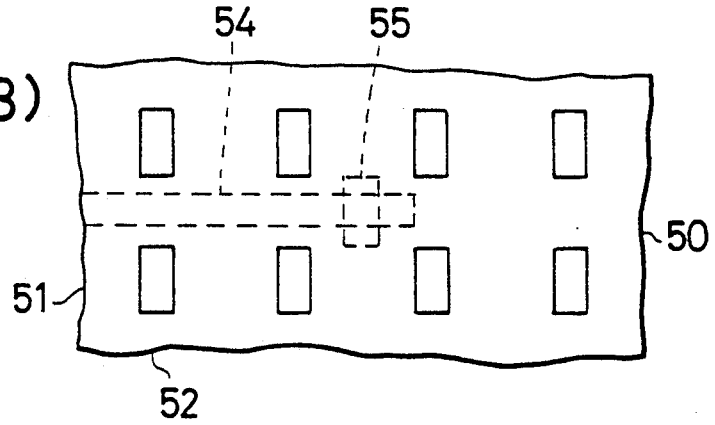

Referring now to FIGS. 24(A) and 24(B), a fourteenth embodiment of a stripline patch type antenna with a slot plate, according to the present invention will be described.

This stripline patch type antenna 50 comprises a plate shaped substrate 51 including a lower metal plate 60 having a rectangular shaped lower slot 55, a dielectric substrate 58, a feed conductor 54 located on the dielectric substrate 58, a dielectric plate 57 placed between the lower metal plate 60 and the dielectric substrate 58, and a grounding conductor plate 59 attached underneath the dielectric substrate 58; an upper metal plate 52 having a plurality of rectangular shaped upper slots 56; and a supporting dielectric member 53 placed between the upper metal plate 52 and the lower metal plate 60 of the substrate 51. As can be see from FIGS. 24(A) and 24(B), the feed conductor 54 is extending to a position below the lower slot 55, while the upper slots 56 are arranged at regular intervals in two rows, along a direction of the feed conductor 54, symmetrically with respect to the lower slot 55.

Each of the dielectric substrate 58, the dielectric plate 57 and the supporting dielectric member 53 is made from an insulative material of small dielectric loss and relative dielectric constant, such as foamed polyethylene.

The feed conductor 54 can be formed by a general wiring method such as etching of a selected portion of a metal foil attached in advance to either the dielectric substrate 58 or the dielectric plate 57, or electroless plating applied to an appropriate conductor element, or silk printing of an appropriate conductor element in paste like state.

The grounding conductor plate 59 is a metallic film formed from a metallic material such as aluminum, iron, copper, nickel, or an alloy containing these metals, which can be manufactured as thin layer formed by a sputtering or vaporization applied to the dielectric substrate 58, or as thin metal foil formed by metal rolling, or electrolyric metal plating, which is attached to the dielectric substrate 58.

The lower metal plate 60 is made from a metallic material such as aluminum, iron, copper, nickel, or an alloy containing these metals, which may be manufactured as a thin layer formed by sputtering or vaporization applied to the dielectric plate 57, or as a thin metal foil formed by metal rolling, or electrolyric metal plating, which is attached to the dielectric plate 57. A part of this lower metal plate 60 is connected with the grounding conductor plate 59 physically.

The upper metal plate 52 is made from a metallic material such as aluminum, iron, copper, nickel, or an alloy containing these metals. The upper slots 56 on this upper metal plate 52 can be formed by press die cutting, etching, or laser manufacturing.

In this stripline patch type antenna 50, when signals to be transmitted are supplied from a transmitter device through the feed conductor 54, the signals are transformed into radio waves by the combination of the feed conductor 54 and the lower slot 55, which is then emitted through the upper slots 56. On the other hand, when the radio wave is received through the upper slots 56, this radio wave is transformed into signals by the combination of the lower slot 55 and the feed conductor 54, and the obtained signals are then supplied to a receiver device through the feed conductor 54.

Thus, in this embodiment, an improved directivity can be achieved by adjusting the shape, number and pitch of the upper slots 56 which function as radio wave lenses.

Moreover, because the transmission and reception of radio waves are achieved by utilizing the substrate 51 in this embodiment, loss due to the feed conductor 54 can be reduced, and the number of radiating elements per unit area can be reduced. As a result, it is possible in this embodiment to reduce the number of non-smooth portions in the wiring so that the loss due to these non-smooth portions can be reduced, which in turn enables to reducing the size of the entire plane antenna when a plurality of the antenna units are arranged in array.

Now, there are various other embodiments of the present invention which can be viewed as variations of the fourteenth embodiment described above. Such embodiments will now be described with references to the drawings, where those elements identical to corresponding elements appeared in the first embodiment are given the same reference numerals in the drawings and their descriptions will be omitted.

Figure 25:
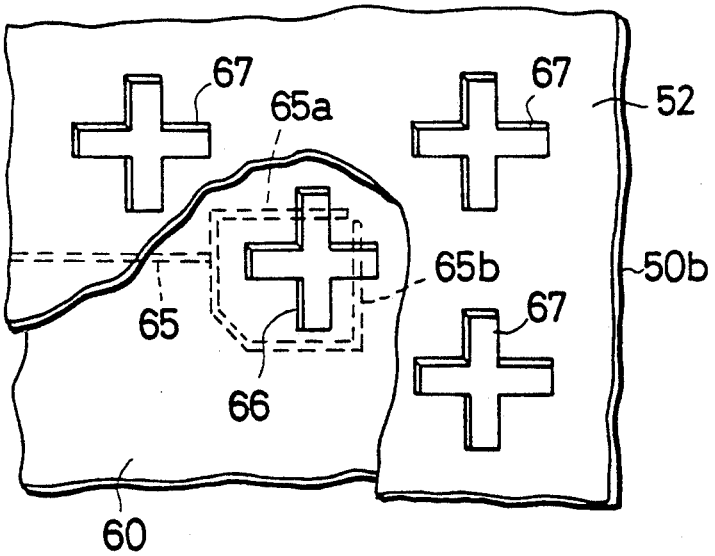
FIG. 25 is a cross sectional view of a fifteenth embodiment of a stripline patch type antenna with a slot plate according to the present invention.

Referring now to FIG. 25, a fifteenth embodiment of a stripline patch type antenna with a slot plate according to the present invention will be described.

In this fifteenth embodiment, the antenna **50*b* differs from the antenna 50 of the fourtheenth embodiment in that the rectangular shaped lower and upper slots 55 and 56 shown in FIG. 24(A) are replaced by cross shaped lower and upper slots 66 and 67, while the feed conductor 54 shown in FIG. 24(A) is replaced by a feed line 65 having two branched ends 65*a* and 65*b* which are oriented in directions crossing at 90° with each other and which have a length difference equal to a quarter of a wavelength to be transmitted or received, where the lower slot 66 is located above the region enclosed by the two branched ends 65*a* and 65*b* of the feed line 65**.

With this configuration, results similar to those obtained for the fourteenth embodiment can also be obtained by this fifteenth embodiment, as the loss due to the feed line 65 can be made small. In addition, it is possible in this embodiment to perform the transmission or reception of the circularly polarized radiation.

Figure 26:
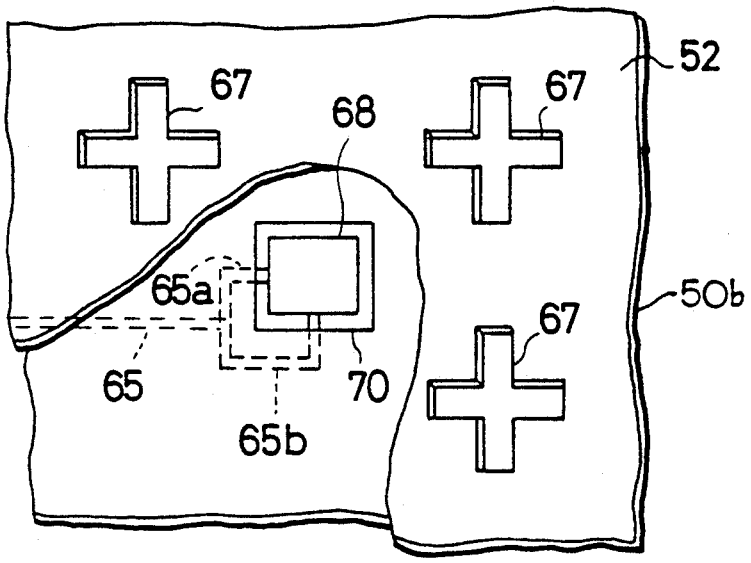
FIG. 26 is a cross sectional view of a sixteenth embodiment of a stripline patch type antenna with a slot plate according to the present invention.

Referring now to FIG. 26, a sixteenth embodiment of a stripline patch type antenna with a slot plate, according to the present invention will be described.

In this sixteenth embodiment, the antenna **50*b* differs from the antenna 50 of the fourteenth embodiment in that the rectangular shaped upper slots 56 shown in FIG. 24(A) are replaced by cross shaped upper slots 67, as in the fifteenth embodiment above, while the feed conductor 54 shown in FIG. 24(A) is replaced by a feed line 65 having two branched ends 65*a* and 65*b* which are connected to two adjacent sides of a square patch 68, and furthermore, the rectangular shaped lower slot 55 is replaced by a square shaped lower slot 70 located above the square patch 68**.

Since this configuration can functions substantially the same manner as that of the fifteenth embodiment above, results similar to those obtained for the fourteenth embodiment can also be obtained by this sixteenth embodiment, and it is also possible in this embodiment to perform transmission or reception of the circularly polarized radiation.

Figure 27:
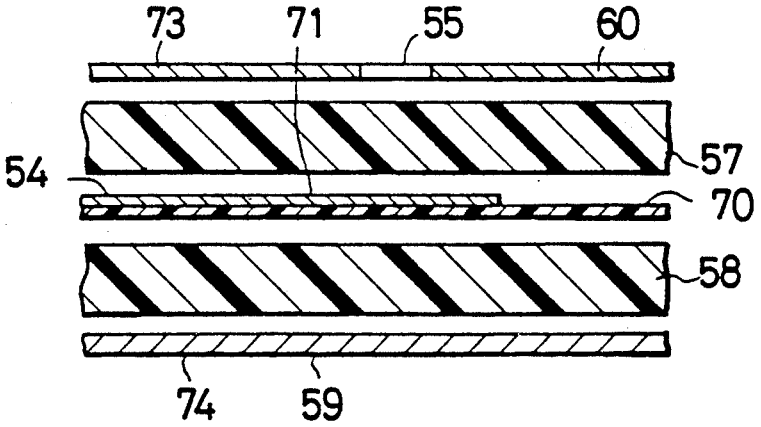
FIG. 27 is an expanded cross sectional view of an example of a stripline patch type antenna with a slot plate according to the present invention, for explaining one possible manner of its construction.

It is to be noted that in the embodiments described above, the antenna may be constructed by combining separately manufactured elements together, rather than using the manufacturing methods described above such as etching, electroless plating, silk printing, sputtering, vaporization, metal rolling, and electrolyric metal plating. Namely, as shown in FIG. 27, the feed conductor 54 is formed by attaching a separately manufactured tape like rolled copper foil 71 on a film-like dielectric member 70, then this feed conductor 54 is sandwiched between the separately prepared dielectric substrate 58 and dielectric plate 57, and then separately prepared conductive plates 73 and 74 are attached as the metal plate 55 and the grounding conductor plate 59.

Besides this, many modifications and variations of the above embodiments may be made without departing from the novel and advantageous features of the present invention. Accordingly, all such modifications and variations are intended to be included within the scope of the appended claims.

What is claimed is:

1. A stripline patch type antenna, comprising:

a single radiating element means for transmitting and receiving radio waves;

feed line means for transmitting signals to and from the radiating element means;

a dielectric substrate for supporting the radiating element means and the feed line means;

a grounding conductor located below the dielectric substrate; and a slot plate located above the dielectric substrate, covering over the radiating element means, and having more than four slots, all of the slots on the slot plate being arranged at regular intervals on a single circular line centered around a position directly above the radiating element means.

2. The antenna of claim 1, wherein the slots are arranged on the slot plate symmetrically with respect to said position directly above the radiating element means.

3. The antenna of claim 1, wherein the radiating element means comprises a metal layer formed on the dielectric substrate.

4. The antenna of claim 1, wherein the grounding conductor comprises a metal layer formed on the dielectric substrate.

5. The antenna of claim 1, wherein the dielectric substrate comprises a dielectric film.

6. The antenna of claim 1, further comprising a dielectric layer between the slot plate and the dielectric substrate.

7. The antenna of claim 6, wherein the dielectric layer is an air layer.

8. The antenna of claim 6, wherein the dielectric layer is a foamed material layer.

9. The antenna of claim 1, further comprising a dielectric layer between the grounding conductor and the dielectric substrate.

10. The antenna of claim 9, wherein the dielectric layer is an air layer.

11. The antenna of claim 9, wherein the dielectric layer is a foamed material layer.

12. The antenna of claim 1, wherein the slot plate comprises a metal plate.

13. The antenna of claim 1, wherein the slot plate comprises a metal foil attached to a dielectric film.

14. The antenna of claim 13, wherein the slots are formed by removing appropriate portions of the metal foil.

15. The antenna of claim 14, wherein the metal foil is above the dielectric film.

16. The antenna of claim 14, wherein the metal foil is below the dielectric film.

17. The antenna of claim 13, wherein the slots are formed by removing portions of the metal foil and the dielectric film corresponding to locations of the slots.

18. The antenna of claim 1, wherein each of the slots is X-shaped and oriented along a different direction.

19. The antenna of claim 1, wherein the radiating element means is located between the dielectric substrate and the slot plate.

20. The antenna of claim 1, wherein the radiating element means is located between the dielectric substrate and the grounding conductor.

21. The antenna of claim 20, further comprising a passive element located between the dielectric substrate and the slot plate at a position directly above the radiating element means.

22. A stripline patch type antenna, comprising:

an antenna substrate member, including:

a lower slot plate having a single lower slot; and a dielectric substrate for supporting feed line means for transmitting signals, the feed line means being extended to a position directly below the lower slot and located entirely below the lower slot plate; and a grounding conductor located below the dielectric substrate; and an upper slot plate located above the antenna substrate member and having a plurality of upper slots more numerous than the lower slot.

23. The antenna of claim 22, wherein one end of the feed line means has two branches which are oriented in directions crossing at 90° with each other and enclosing a region, and where the lower slot is located above the region enclosed by the two branches.

24. The antenna of claim 23, wherein the two branches of said one end of the feed line means have a length difference equal to a quarter wavelength of signals to be transmitted.

25. A stripline patch type plane antenna, comprising:

a plurality of antenna units arranged in array, each antenna unit including:

a single radiating element means for transmitting and receiving radio waves;

feed line means for transmitting signals to and from the radiating element means;

a dielectric substrate for supporting the radiating element means and the feed line means;

a grounding conductor located below the dielectric substrate; and a slot plate located above the dielectric substrate, covering over the radiating element means, and having more than four slots, all of the slots on the slot plate being arranged at regular intervals on a single circular line centered around a position directly above the radiating element means.

26. A stripline patch type antenna, comprising:

a single radiating element means for transmitting and receiving radio waves;

feed line means for transmitting signals to and from the radiating element means;

a dielectric substrate for supporting the radiating element means and the feed line means;

a grounding conductor located below the dielectric substrate; and a slot plate located above the dielectric substrate and having more than four slots of identical shape, one of the slots on the slot plate being arranged at a position directly above the radiating element means while remaining ones of the slots on the slot plate being arranged at regular intervals on a circular line centered around the position directly above the radiating element means.

27. A stripline patch type antenna, comprising:

an antenna substrate member, including:

a lower slot plate having a lower slot;

a dielectric substrate for supporting a feed line for transmitting signals, the feed line means being extended to a position directly below the lower slot; and a grounding conductor located below the dielectric substrate; and an upper slot plate located above the antenna substrate member and having a plurality of upper slots more numerous than the lower slot;

one end of the feed line means has two branches which are connected to two adjacent sides of a square patch; and the lower slot is located above the square patch.

28. A stripline patch type plane antenna, comprising:

a plurality of antenna units arranged in array, each antenna unit including:

a single radiating element means for transmitting and receiving radio waves;

feed line means for transmitting signals to and from the radiating element means;

a dielectric substrate for supporting the radiating element means and the feed line means;

a grounding conductor located below the dielectric substrate; and a slot plate located above the dielectric substrate and having more than four slots; wherein the antenna units are arranged such that at least one of the slots of said antenna unit is shared by another one of the said antenna units arranged adjacent to said each antenna unit as one of the slots of said another one of said antenna units.

29. The antenna of claim 28, wherein said each antenna unit has its respective slots arranged at regular intervals on a circle centered around the position directly above its respective radiating element means, and wherein the slots of said each antenna unit shared by another one of said antenna units are located at intersections of circles for said each antenna unit and said another one of said antenna units.

30. The antenna of claim 28, wherein said each antenna unit has its respective slots arranged along a rectangle, and wherein the slots of said each antenna unit shared by another one of said antenna units are located on corners of said each antenna unit shared with said another one of said antenna units.

31. The antenna of claim 28, wherein each said antenna unit has its respective slots arranged along a rectangle, and wherein the slots of each said antenna unit shared by another one of said antenna units are located on sides of said each antenna unit shared with said another one of said antenna units.

32. A stripline patch type antenna, comprising:

a central radiating element means for transmitting and receiving radio waves;

feed line means for transmitting signals to and from the central radiating element means;

a dielectric substrate for supporting the central radiating element means and the feed line means;

a grounding conductor located below the dielectric substrate;

a slot plate located above the dielectric substrate and having more than four slots, one of the slots on the plate being arranged at a position directly above the central radiating element means and remaining ones of the slots on the slot plate being arranged at regular intervals on a single circular line centered around a position directly above the central radiating element means; and additional radiating element means which is located below one of the slots.

* * * * *